US008814304B2

(12) United States Patent
Miyahara

(10) Patent No.: US 8,814,304 B2
(45) Date of Patent: Aug. 26, 2014

(54) PRINTING APPARATUS

(75) Inventor: Katsutoshi Miyahara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 87 days.

(21) Appl. No.: 13/557,124

(22) Filed: Jul. 24, 2012

(65) Prior Publication Data

US 2013/0187969 A1 Jul. 25, 2013

(30) Foreign Application Priority Data

Aug. 1, 2011 (JP) ..... 2011-168711

(51) Int. Cl.
*B41J 29/38* (2006.01)

(52) U.S. Cl.
USPC ..... 347/14; 347/9; 347/19

(58) Field of Classification Search
CPC ..... B41J 29/38; B41J 2/07
See application file for complete search history.

(56) References Cited

U.S. PATENT DOCUMENTS

| | | | | |
|---|---|---|---|---|
| 4,653,940 | A | 3/1987 | Katsukawa | |
| 5,581,281 | A * | 12/1996 | Fuse | 347/14 |
| 6,155,663 | A | 12/2000 | Takayanagi | |
| 6,857,717 | B2 * | 2/2005 | Misumi | 347/14 |
| 7,264,326 | B2 * | 9/2007 | Kubo et al. | 347/17 |
| 7,347,519 | B2 | 3/2008 | Nagamura et al. | |
| 7,556,345 | B2 * | 7/2009 | Suzuki et al. | 347/41 |
| 7,575,292 | B2 * | 8/2009 | Furukawa | 347/5 |
| 2005/0264593 | A1 * | 12/2005 | Nagamura et al. | 347/5 |

FOREIGN PATENT DOCUMENTS

| | | | |
|---|---|---|---|
| JP | 4-115950 | A | 4/1992 |
| JP | 6-47290 | B | 6/1994 |
| JP | 3-179674 | B2 | 6/2001 |
| JP | 3-376118 | B2 | 2/2003 |
| JP | 2005-224955 | A | 8/2005 |
| JP | 2006-7759 | A | 1/2006 |

* cited by examiner

*Primary Examiner* — Manish S Shah
*Assistant Examiner* — Jeremy DeLozier
(74) *Attorney, Agent, or Firm* — Fitzpatrick, Cella, Harper & Scinto

(57) ABSTRACT

This invention is made to solve a problem that the power supply cannot be used efficiently because, even when the normally operable ambient temperature of an apparatus is low, the supplied power of the power supply is restricted in consideration of a case in which the ambient temperature is high. To solve this, a temperature sensor measures the temperature of a predetermined portion of a printing apparatus or an ambient temperature. The driving count of printing elements used to print in a region by one scan is compared with a threshold determined in accordance with the measured temperature, and an appropriate printing mode is selected. When the ambient temperature of the printing apparatus is low, a large power can be supplied to the printhead, increasing the efficiency of the power supply.

9 Claims, 8 Drawing Sheets

PRINTING APPARATUS

BACKGROUND OF THE INVENTION

1. Field of the Invention

The present invention relates to a printing apparatus and, particularly, to an inkjet printing apparatus configured to efficiently use a limited power supply capacity of the apparatus.

2. Description of the Related Art

An inkjet printing apparatus (to be referred to as a printing apparatus hereinafter) prints by discharging ink from a printhead using an electrothermal transducer (heater) as a printing element. The printing apparatus prints an image on printing paper by heating the printing element in accordance with image data and discharging ink. To meet a requirement for shortening the printing time, recent printing apparatuses tend to employ large-scale printheads in which a larger number of printing elements are integrated at high density. Thus, the consumption power of the printhead tends to increase. Along with an increasing speed of a carriage which supports the printhead, it is becoming necessary to install a power supply having a large capacity in the printing apparatus.

The load of the printhead greatly changes depending on a printing image and printing mode. For example, even in the same printing mode, the count and frequency at which the printing elements of the printhead are driven differ between a low-density image and a high-density image, so the load of the printhead also changes. Even for the same printing image, the load of the printhead changes between a high carriage speed and a low carriage speed. When performing multi-pass printing, the load of the printhead greatly changes depending on the number of passes. If the power supply is designed in accordance with a possible maximum power load in consideration of these changes, it becomes very large and expensive.

In some cases, to prevent increases in the size and cost of the power supply, the printing apparatus executes printing operation control to suppress the power load to a predetermined level, and the power supply is designed in accordance with the power load.

To restrict the power load by controlling the printing operation, there is a method of detecting the driving count of printing elements in the printhead in association with the size of a partial region in the scan region, and when the driving count of printing elements is higher than a predetermined value, decreasing the carriage speed or performing divisional printing. This method controls driving of printing elements (see, for example, Japanese Patent Laid-Open No. 4-115950, Japanese Patent Publication No. 6-047290, Japanese Patent Laid-Open Nos. 2005-224955 and 2006-007759, and Japanese Patent Nos. 3179674 and 3376118). This control is also called power monitoring control. A printing element driving count proportional to a power load is detected before printing. When the count exceeds the suppliable power of the power supply, driving of printing elements is controlled to reduce the load. Only when the load of the printhead may exceed the suppliable power of the power supply, this control can reduce the load without excessively decreasing the printing speed. Hence, this method is effective for cost reduction of the power supply.

In general, the suppliable power of a power supply is also related to the temperature ratings of components installed in the power supply. The power supply is designed so that the temperatures of the components installed in the power supply do not exceed their temperature ratings when a rated power is kept supplied. Within the normally operable temperature range of the printing apparatus, the apparatus is expected to operate normally. Therefore, the power supply needs to be designed on the premise of a highest temperature within the normally operable temperature range. The component temperature is proportional to the power load of the power supply. When the ambient temperature of the power supply is low, a power load required for the component temperature to reach the temperature rating becomes higher than that when the ambient temperature is high.

However, the related arts adopt a fixed threshold regardless of the ambient temperature in order to limit the load on the printhead. Even when the ambient temperature is low, no large power can be output. If a larger power can be supplied, the power load of the printhead per unit time can be increased. As a result, the driving control count by power monitoring control is decreased, and an increase in printing speed is expected.

SUMMARY OF THE INVENTION

Accordingly, the present invention is conceived as a response to the above-described disadvantages of the conventional art.

For example, a printing apparatus according to this invention are capable of making full use of the performance of a power supply in accordance with the normally operable ambient temperature of the apparatus.

According to one aspect of the present invention, there is provided a printing apparatus comprising: a printhead in which a plurality of printing elements are arrayed; a scanning unit configured to scan the printhead with respect to a printing medium in order to print on the printing medium; a reception unit configured to receive, from a host, print data for printing by the printhead; a temperature sensor configured to measure a temperature of a predetermined component of the printing apparatus or an ambient temperature of the printing apparatus; a storage unit configured to store a count at which the plurality of printing elements are drivable, as a threshold for each section of a temperature range in each of a plurality of printing modes having different consumption powers of the printhead per unit time; a calculation unit configured to, when printing is performed in a printing mode selected in advance from the plurality of printing modes, calculate a driving count of the plurality of printing elements for one scan of a carriage based on print data for one scan that has been received by the reception unit; and a driving control unit configured to, in a case where the driving count of the plurality of printing elements that has been calculated by the calculation unit is equal to or less than the threshold selected from the storage unit based on a temperature measured by the temperature sensor and the printing mode selected in advance, drive the printhead to print the print data for one scan by one scan in the printing mode selected in advance, and in a case where the driving count of the plurality of printing elements that has been calculated by the calculation unit is larger than the threshold, drive the printhead to print the print data for one scan by a plurality of scans.

According to another aspect of the present invention, there is provided a printing apparatus comprising: a printhead in which a plurality of printing elements are arrayed; a scanning unit configured to scan the printhead; a temperature sensor configured to measure a temperature of a predetermined component of the printing apparatus or an ambient temperature of the printing apparatus; a storage unit configured to store a count at which the plurality of printing elements are drivable, as a threshold for each section of a temperature range measured by the temperature sensor in each of a plurality of printing modes having modes in which maximum values of powers consumable per unit time are different; an input unit configured to input information which designates print data, and a printing mode from the plurality of printing modes; an acquisition unit configured to acquire a driving count of the plurality of printing elements per scan of the printhead for each print data for one scan in print data input by the input unit; and a decision unit configured to decide, based on a threshold selected based on a temperature measured by the temperature sensor and the printing mode selected in advance, and the driving count acquired by the acquisition unit, whether to print the print data for one scan by one scan or print the print data for one scan divisionally by a plurality of scans.

The invention is particularly advantageous since the load of a printhead is changed in accordance with the suppliable power of a power supply that changes depending on the ambient temperature, and the power supply of the apparatus can be used efficiently.

Further features of the present invention will become apparent from the following description of exemplary embodiments (with reference to the attached drawings).

DESCRIPTION OF THE EMBODIMENTS

An exemplary embodiment of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "printing element" (to be also referred to as a "nozzle") generically means an ink orifice or a liquid channel communicating with it, and an element for generating energy used to discharge ink, unless otherwise specified.

Especially in this embodiment, an electrothermal transducer (heater) is used as the element for generating energy used to discharge ink. The heater is energized to generate heat, and ink is discharged by bubbling power of a bubble generated near the orifice by the heat.

Figure 1:
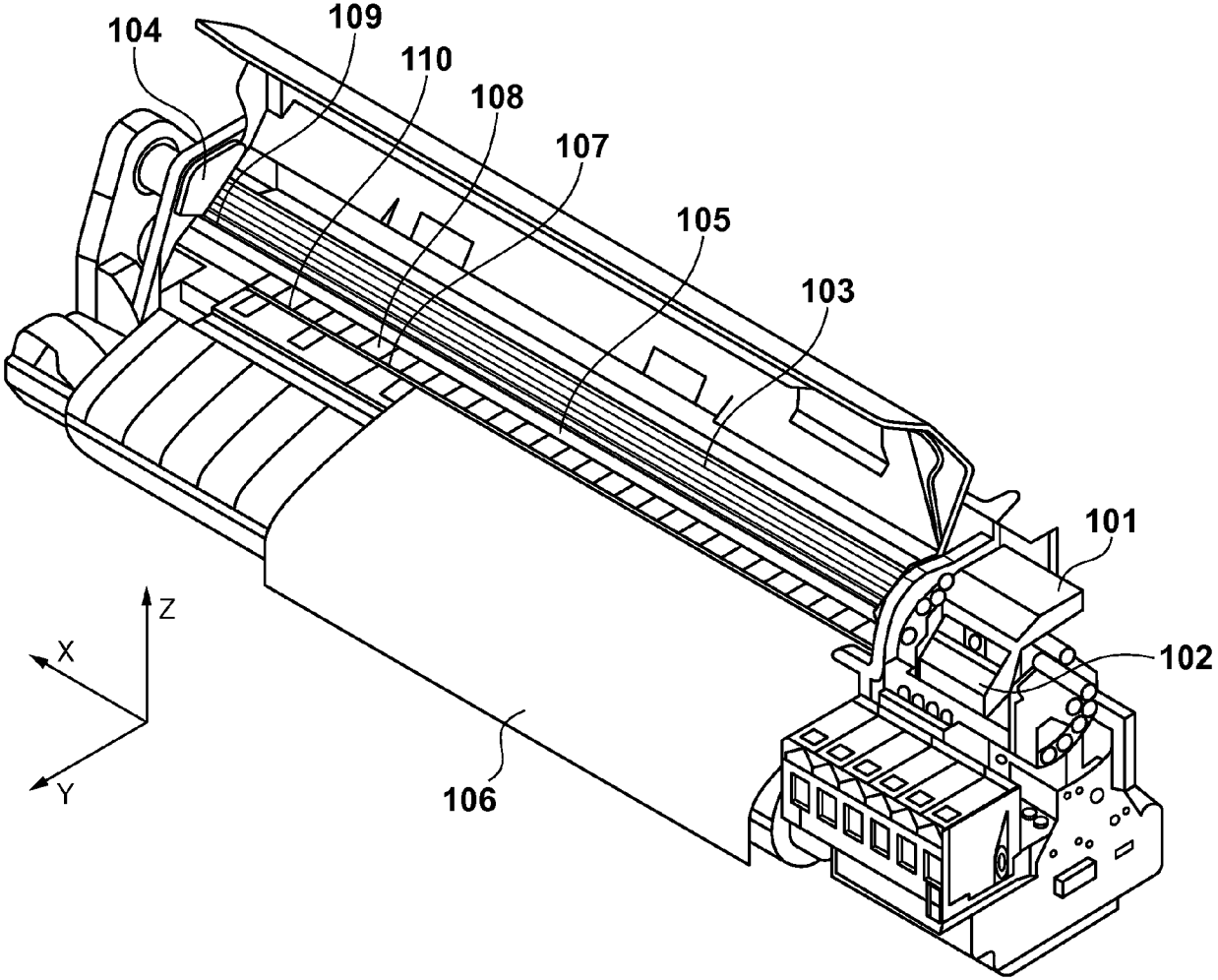
FIG. 1 is a perspective view showing the schematic arrangement of an inkjet printing apparatus as a typical embodiment of the present invention.

FIG. 1 is a perspective view showing the schematic arrangement of an inkjet printing apparatus 1 (to be referred to as a printing apparatus hereinafter) as a typical embodiment of the present invention.

As shown in FIG. 1, a carriage 101 supports an inkjet printhead (to be referred to as a printhead hereinafter) 102 on which a plurality of printing elements (heaters) are arrayed. The carriage 101 is connected to a carriage motor (CR motor) 104 via a conveyance belt 103. The carriage 101 reciprocally scans in the X-axis direction on a shaft 105 along with rotation of the CR motor 104. When the carriage 101 passes above a printing medium 106, such as printing paper, ink droplets are discharged upon heating by the heaters from a plurality of nozzles, which are arrayed on the printhead 102 in a direction perpendicular to the scanning direction (main scanning direction) of the carriage 101. The ink droplets are discharged at a timing corresponding to print data, forming an image on the printing medium 106.

The printing medium 106 is nipped by a line feed roller (LF roller) 107 and pinch roller 108. The printing medium 106 is conveyed in a direction (sub-scanning direction) perpendicular to the main scanning direction on a platen 110 along with rotation of an LF motor 109 connected to the LF roller 107. A plurality of holes are formed in the platen 110. Air is sucked via these holes by rotation of a platen suction fan (not shown), absorbing the printing medium 106 on the platen 110. Accordingly, floating of the printing medium 106 during the printing operation is controlled.

Figure 2:
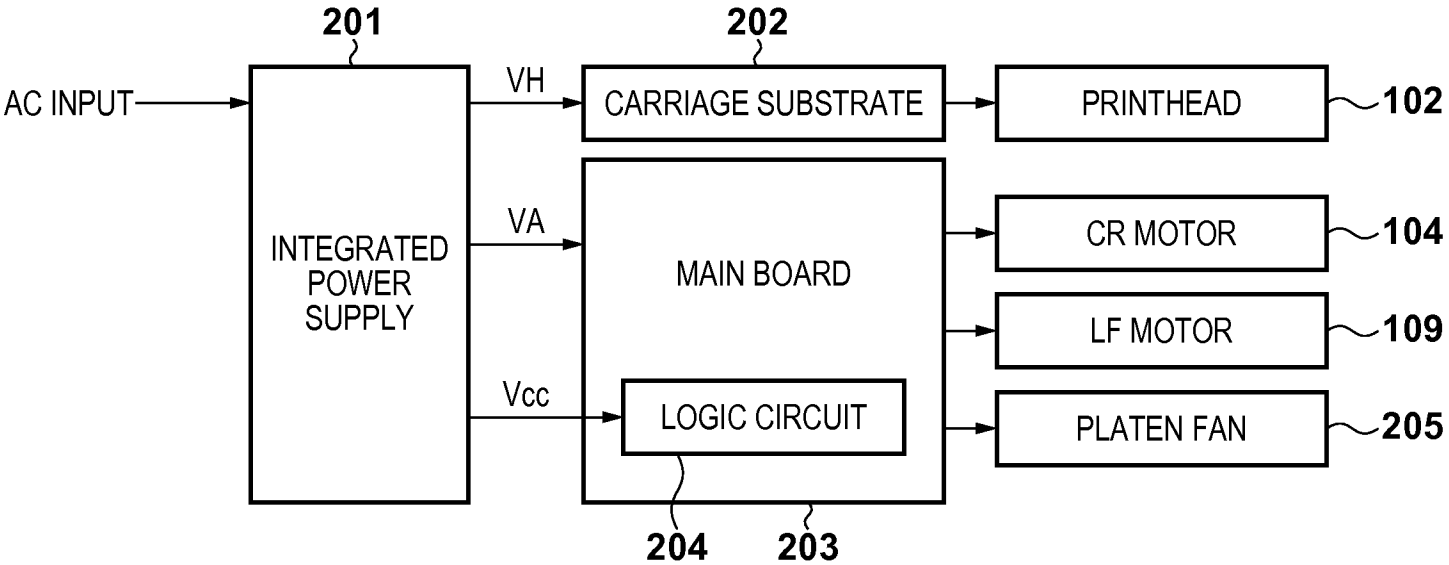
FIG. 2 is a block diagram showing the power supply channel of the printing apparatus shown in FIG. 1.

FIG. 2 is a block diagram showing the power supply channel of the printing apparatus 1 shown in FIG. 1.

An integrated power supply 201 is a switching DC stabilized power supply, and is designed to be able to output three DC voltages.

The voltages supplied from the integrated power supply 201 are a head driving voltage VH, logic circuit voltage Vcc, and actuator driving voltage VA. The head driving voltage VH is supplied to a carriage substrate 202 via a flexible cable which connects the carriage 101 and the main body of the printing apparatus, and supplied to the printhead 102 connected to the carriage substrate 202. The head driving voltage VH is monitored around the printhead 102, and feedback-controlled so that a voltage drop caused by the resistance of the flexible cable or the like can be suppressed to maintain a stable voltage level.

The logic circuit voltage Vcc is used to drive a logic circuit 204 on a main board 203. The logic circuit voltage Vcc is converted into a plurality of voltages by a DC/DC converter, regulator, and the like on the main board 203, and these voltages are supplied to respective units such as a CPU and memory.

The actuator driving voltage VA is used to drive a motor, fan, and the like necessary for the printing operation, and supplied to respective actuators via the main board 203. The actuators are the CR motor 104, the LF motor 109, a platen fan 205, and the like, as described above. The voltage is converted on the main board 203 in accordance with the driving voltages of these actuators, and these voltages are supplied to the respective actuators.

The power supply capacity of the integrated power supply 201 is determined by the consumption powers of the actuator, printhead 102, logic circuit, and the like in printing. However, the load of the printhead 102 greatly varies depending on the printing mode and print data. If the power capacity of the integrated power supply 201 is decided in accordance with the maximum load, the integrated power supply 201 becomes large and expensive. To prevent this, a capacity large enough to achieve a target printing time determined from the application purpose of the printing apparatus and the like is generally obtained to design the integrated power supply 201 based on the capacity.

The temperature in some electric components which form the power supply circuit of the integrated power supply 201 rises depending on the magnitude of the load. These components are required not to exceed their temperature ratings upon application of a load equal to a rated capacity to the integrated power supply 201 within the normally operable ambient temperature range, so a heat dissipation measure is sometimes taken. A general heat dissipation measure is to mainly attach a heatsink or the like for each component. As an additional method, heat is dissipated by a fan or the like. Since an excessive heat dissipation measure raises the cost, these measures are also optimized based on the normally operable ambient temperature range and the rated capacity of the integrated power supply 201.

Figure 3:
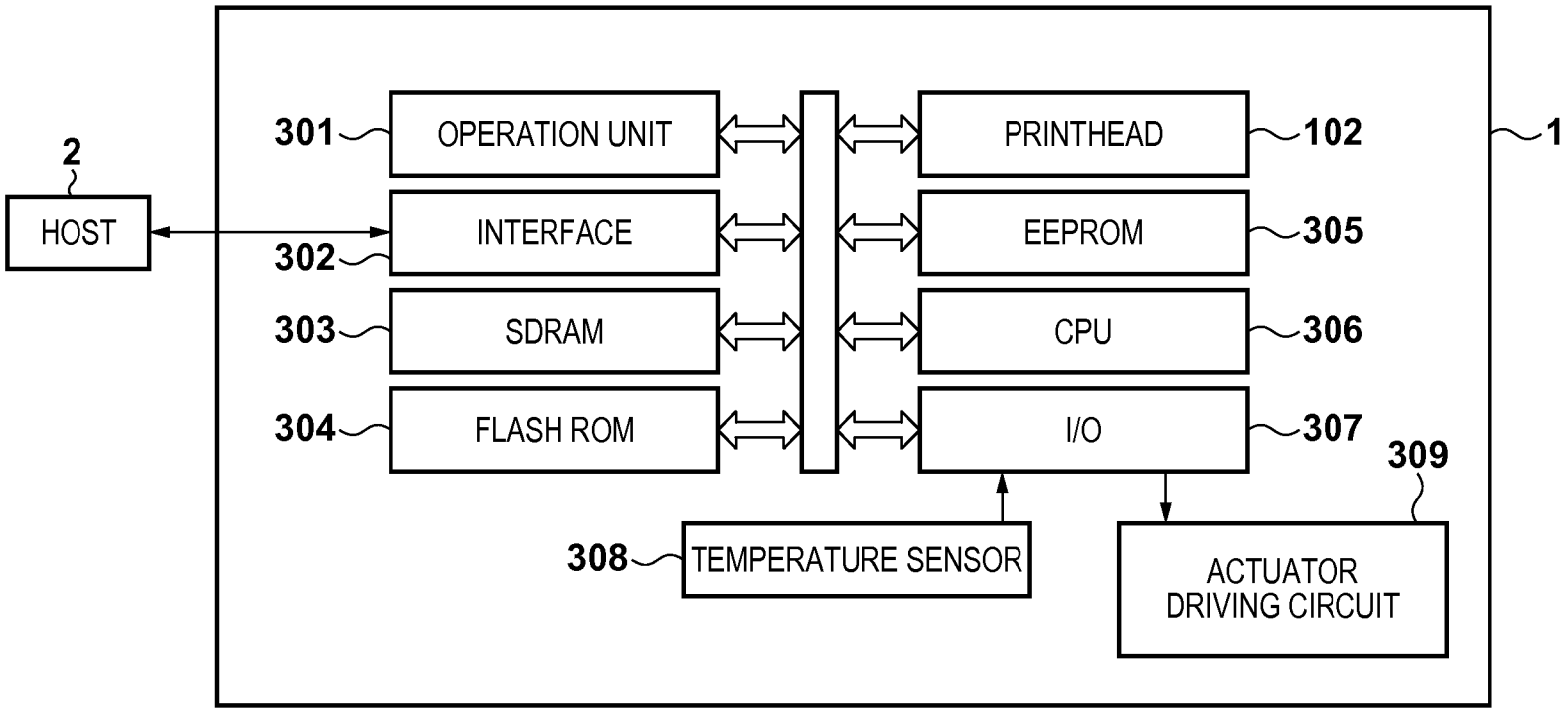
FIG. 3 is a block diagram showing the control arrangement of the printing apparatus shown in FIG. 1.

FIG. 3 is a block diagram showing the control arrangement of the printing apparatus 1 shown in FIG. 1.

Referring to FIG. 3, an operation unit 301 includes various keys, an LCD, and an LED lamp. The operation unit 301 is used to accept a key operation from the user, display information on the LCD, and represent an apparatus state by the LED lamp. An interface 302 conforms to the USB or LAN specification. The interface 302 is used to receive a print job from a host computer (to be referred to as a host 2 hereinafter), and transmit the state of the printing apparatus to the host. An SDRAM 303 temporarily holds programs and print data. A flash ROM 304 stores threshold data used in power monitoring control, in addition to firmware data and mask data. An EEPROM 305 holds history information of the printing apparatus including various set values and the print count. A CPU 306 performs image processing for print data and conversion processing into discharge data. Further, the CPU 306 performs dot count processing of counting the ink discharge count of the printhead 102, and power monitoring control of comparing a dot count value with a threshold to decide a driving control method. An input/output unit (I/O) 307 includes input/output ports for signals for controlling various actuators in the printing apparatus and detecting a sensor state. A temperature sensor 308 is used to measure the ambient temperature of the printing apparatus, and can measure a temperature via the I/O 307. An actuator driving circuit 309 drives various actuators upon receiving control signals from the I/O 307.

Two embodiments will be described with reference to the accompanying drawings in regard to printing control to be executed in a printing apparatus having the above arrangement.

[First Embodiment]

Figure 4:
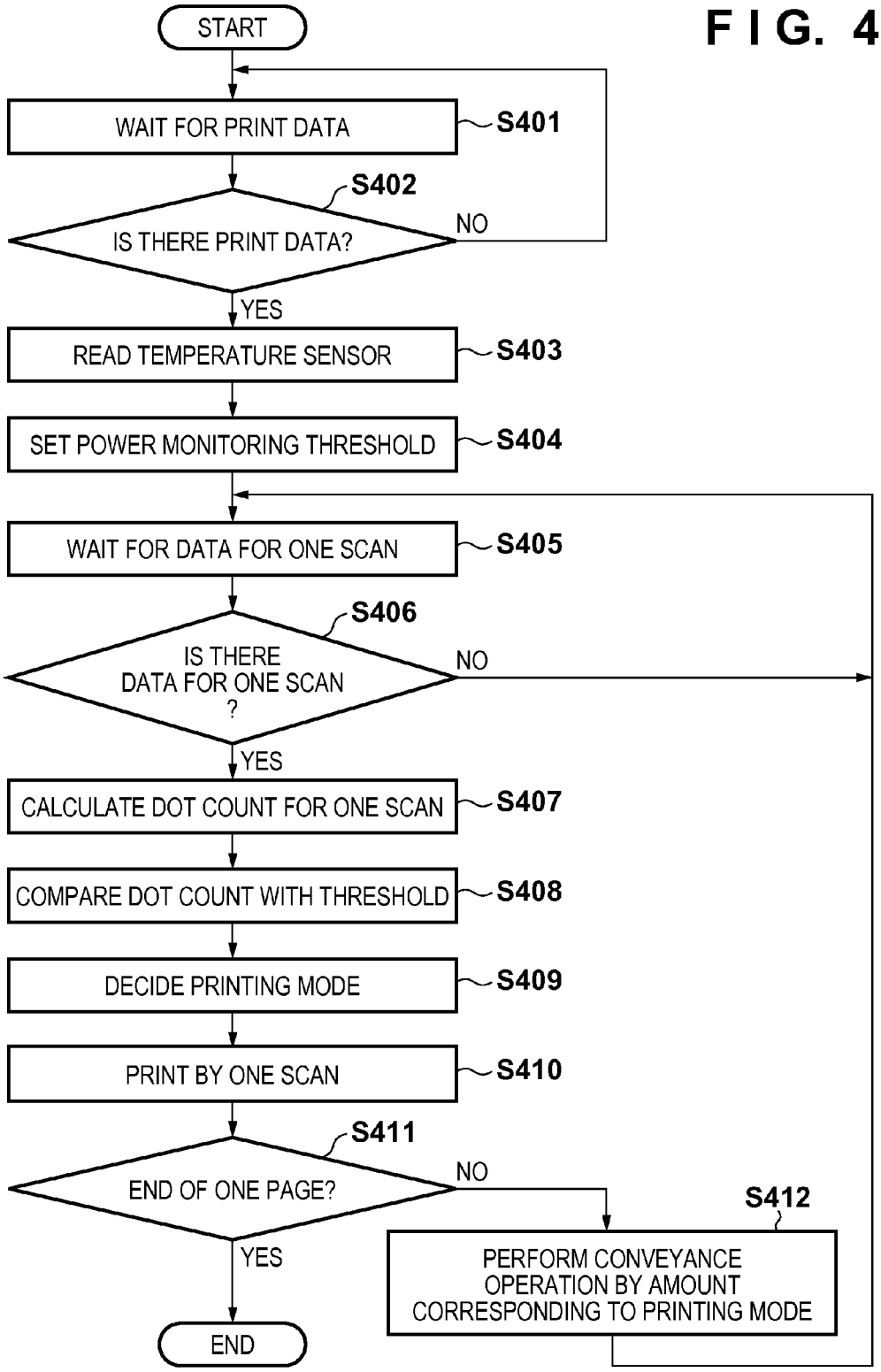
FIG. 4 is a flowchart showing printhead driving power control processing.

FIG. 4 is a flowchart showing printing control processing according to the first embodiment.

In steps S401 and S402, the printing apparatus is turned on by operating an operation unit 301 by the user, and waits for transmission of a print job (print data) from the host in the print data standby state or power saving state. The print job contains print data, and information designating a printing mode. As the printing mode, an image quality-oriented mode, speed-oriented mode, and standard mode are prepared for each paper type. If it is confirmed in step S402 that the host has transmitted print data, the process advances to step S403 to measure the ambient temperature of the printing apparatus by a temperature sensor 308 attached within the main body, in order to determine control in printing.

After measuring the ambient temperature, a power monitoring threshold Dth is read out from a flash ROM 304 and set in step S404. The power monitoring threshold Dth stored in the flash ROM 304 is set for each combination of the printing mode and ambient temperature. The ambient temperature interval is set to six (6) stages from 10° C. to 35° C. at an interval of 5° C. The printing mode is determined by combinations of three resolutions of 1200×600 dpi, 1200×1200 dpi, and 1200×2400 dpi, five printing pass counts of 1, 2, 4, 8, and 16, and four carriage speeds of 25, 30, 40, 50 inches/sec. Based on these combinations, a plurality of printing modes mentioned above can be executed for each printing medium type.

Even for the same print data, the printing apparatus can print in a printing mode selected from a plurality of printing modes having different consumption powers of the printhead per unit time. Note that even for the same print data, the maximum consumption power of the printhead per unit time changes depending on the printing mode. A plurality of printing modes include single pass printing which completes printing in the entire region scanned by one scan printing of the printhead, multi-pass printing of completing printing in the same region by a plurality of scan print operations, high-speed printing using a high carriage speed, and normal printing using a low carriage speed. In addition, the printing modes include high-resolution printing, intermediate-resolution printing, and low-resolution printing according to the resolution of print data transmitted from the host. Each printing mode is printing determined from these printing combinations, and the consumption power of the printhead per unit time differs between the modes.

For example, in a printing mode having an ambient temperature of 24° C., 1200×600 dpi, one pass, and 50 inches/sec, a power monitoring threshold Dth recorded in a temperature region of 20° C. to 25° C. in this printing mode is referred to.

The power monitoring threshold Dth is a threshold to be compared with the total driving count (dot count) of all heaters of a printhead 102 in one scan of a carriage 101. The threshold is determined according to the following procedures. First, while managing the ambient temperature of the printing apparatus, a predetermined load is applied to an integrated power supply 201 installed in the printing apparatus. Then, temperature changes of electric components installed in the integrated power supply 201 are monitored. Electric components whose temperature readily rise in the integrated power supply 201 are an FET (Field Effect Transistor) serving as a switching transistor, and a rectification diode. A component which may first exceed the temperature rating upon increasing the load, and the output power amount of the integrated power supply 201 at this time can be obtained from the relationship between the load of the integrated power supply 201 and the rise of the component temperature.

Figure 5:
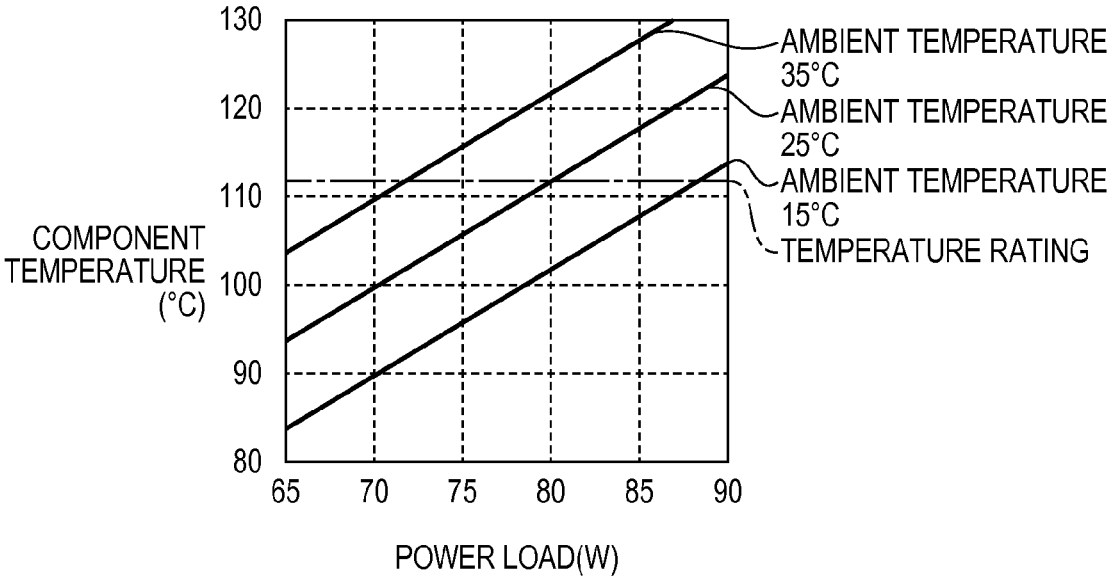
FIG. 5 is a graph showing consumption power and a temperature change of a power supply element.

FIG. 5 is a graph schematically showing, for each ambient temperature, the relationship between the load of the integrated power supply 201 and the temperature of a component installed in the integrated power supply 201.

As shown in FIG. 5, the component temperature rises while the ambient temperature is offset. Thus, when the ambient temperature is high, the component temperature reaches the temperature rating at a lower power load than that when the ambient temperature is low. The relationship between the output power of the integrated power supply 201 and the component temperature is measured for each ambient temperature of the printing apparatus, for example, at an interval of 5° C. In this manner, a power load necessary for the temperature of a component installed in the integrated power supply 201 to reach the temperature rating can be obtained for each ambient temperature of the printing apparatus. This means that the integrated power supply 201 can output power at a value smaller than this power load. A value obtained by subtracting the consumption power amount of the power supply channel other than a head power consumed in the operation from the thus-obtained outputtable power amount for each ambient temperature serves as a power usable in the head power supply. The consumption power of the power supply channel other than the head power can be set as an almost fixed value for each printing mode. Therefore, the consumption power of the power supply channel other than the head power in each printing mode is subtracted from the outputtable power amount of the integrated power supply 201, obtaining the remaining power amount.

Once a power amount consumable in the printhead is obtained for each ambient temperature and printing mode, the heater drivable count per scan can be calculated. One scan of the carriage 101 includes the printing period and non-printing period. In the printing period, the printhead mounted in the carriage 101 can discharge ink droplets toward a printing medium 106. In the non-printing period, the carriage 101 performs acceleration, deceleration, and reverse of the scanning direction and, the printhead mounted in the carriage 101 does not discharge ink droplets toward the printing medium 106. The length of each period changes depending on the carriage speed and the width of the printing medium 106. Assuming that the width of the printing medium 106 is a maximum width printable by the printing apparatus, the printing period and non-printing period can be obtained for each carriage speed. Letting Pt be the average consumable power of the printhead 102 at the ambient temperature of the printing apparatus in a given printing mode, T1 be the printing period, T2 be the non-printing period, and Po be the consumption power of the printhead 102 during the printing period, the consumption power Po during the printing period can be calculated according to the following equation:

$$Po=Pt\times(T1+T2)/T1$$

The calculated consumption power Po during the printing period is divided by a power consumed by one heater in one driving, obtaining a heater drivable count during the printing period. This value serves as a heater drivable count by one scan of the carriage 101. After the heater drivable count by one scan is obtained for each printing mode and each ambient temperature of the printing apparatus, this value is stored as the power monitoring threshold Dth in the flash ROM 304 of the printing apparatus.

Figure 6:
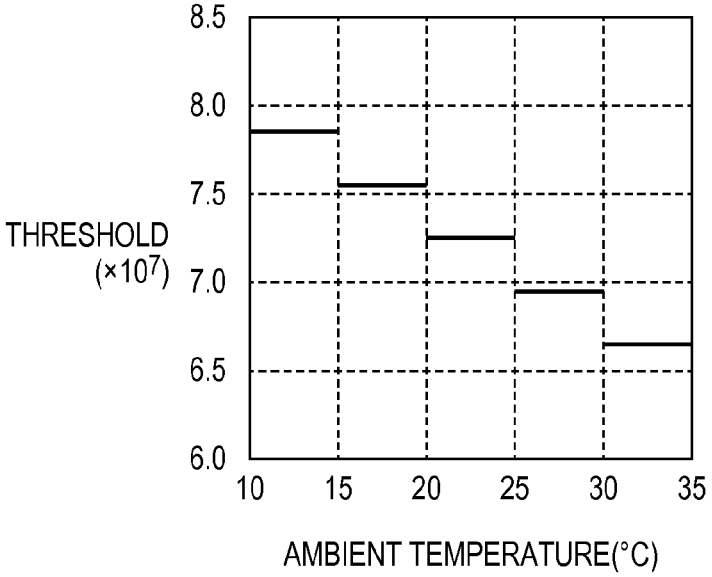
FIG. 6 is a graph showing the relationship between the ambient temperature and the power monitoring threshold.

FIG. 6 is a graph showing a change of the power monitoring threshold Dth with respect to the ambient temperature in one printing mode. As shown in FIG. 6, as the ambient temperature rises, the value of the power monitoring threshold Dth decreases. In the embodiment, ambient temperatures are sectioned at an interval of 5° C., so the power monitoring threshold Dth changes stepwise as shown in FIG. 6. However, this interval can be widened or narrowed in accordance with the capacity of the flash ROM 304. If the temperature interval is narrowed, load control of the printhead 102 can be performed for each section of a smaller unit, but the flash ROM 304 requires a larger capacity. If the temperature interval is widened, the capacity of the flash ROM 304 can be suppressed small, but the load control accuracy of the printhead 102 becomes poor. The temperature interval is therefore determined based on the tradeoff with requested load accuracy.

The power monitoring threshold Dth stored in the flash ROM 304 has a value assuming a case in which the width of the printing medium 106 has a maximum size feedable to the printing apparatus. When the width of the printing medium 106 set in the printing apparatus is smaller, the power monitoring threshold Dth is calculated again in accordance with this width.

Referring back to FIG. 4, after the power monitoring threshold Dth corresponding to the width of the printing medium 106 is set, the process waits for transmission of print data for one scan of the carriage 101 from the host in step S405. A CPU 306 performs image processing for the transmitted print data, converts it into data for driving the heaters of the printhead 102, and then accumulates the converted data in an SDRAM 303.

The process advances to step S406 to confirm accumulation of print data for one scan in the SDRAM 303. After accumulating print data for one scan, the process advances to step S407, and the CPU 306 calculates the total heater driving count (dot count) in this scan.

Figure 7:
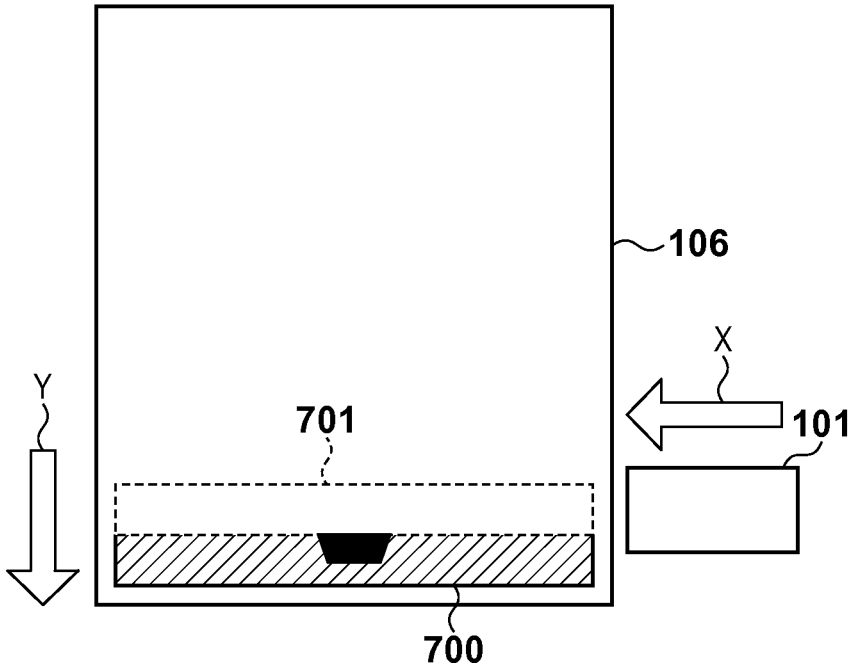
FIG. 7 is a view for explaining a dot count region.

FIG. 7 is a view showing a region for which the dot count is calculated in a 1-pass (single pass) printing mode. In FIG. 7, a hatched region 700 represents a region having undergone 1-pass printing.

The dot count can be obtained by adding counts at which the respective heaters of the printhead 102 are driven in a region 701 on the printing medium 106 printed by one scan of the carriage 101. For example, in a 1-pass printing mode having a printing resolution of 1200×2400 dpi and a printing region width of 25.4 mm×900 mm, the dot count is a maximum of about $1.0\times10^8$. In a 2-pass printing mode (mode in which the same region is printed by two carriage scans), the dot count is a maximum of about $5.0\times10^7$.

After the dot count calculation, the process advances to step S408 to compare the dot count with the set power monitoring threshold Dth, and to step S409 to decide, based on the result, a printing mode for printing the region. When the printing duty (ratio of an actually printed region to the printing region) is 80% at 1-pass printing mode settings, the dot count in a 25.4 mm×900 mm region is $8.2\times10^7$. The power monitoring threshold Dth is $7.3\times10^7$ when the ambient temperature is 24° C., so the dot count exceeds the power monitoring threshold Dth.

When the dot count for one scan exceeds the power monitoring threshold Dth in the designated printing mode (1-pass printing mode), it is decided to divide data for one scan in order to decrease the number of heaters used in one scan of the carriage 101.

As a method of prolonging the printing time, the number of heaters used in one scan of the carriage 101 is halved, and a region which is originally printed by one scan is printed by two scans. As another method, the carriage speed is decreased by one step, and the heater driving count per unit time is decreased to print. Alternatively, these methods may be combined to decrease the heater driving count per unit time. However, when a printing mode in which the heater driving count per unit time is decreased excessively is selected, the printing time becomes long. Thus, a printing mode in which prolongation of the printing time is prevented as much as possible is desirably selected as the next candidate.

A method of decreasing the number of heaters used in one scan and increasing the scan count of the carriage 101 will be exemplified. When the dot count exceeds the power monitoring threshold Dth in one carriage scan, a mode in which the number of heaters used in one carriage scan is halved to print the region 701 by two carriage scans is selected. That is, the scan count is incremented by one to print data for one scan. This division may divide the nozzle array into upper and lower halves or at random. At an interval between two carriage scans, the printing medium 106 is not conveyed.

The dot count for original one scan is calculated again for the divisional scanning, and the recalculated dot count value is compared with the power monitoring threshold Dth. The dot count is $8.2\times10^7$ in an initial printing mode, and about $4.1\times10^7$ in one scan upon division into two scans. The recalculated dot count therefore becomes lower than the power monitoring threshold Dth, and printing becomes possible. If the dot count is still higher than the threshold Dth even in this printing mode, a mode in which the number of heaters used in one carriage scan is divided into four to print the region 701 by four carriage scans is selected. That is, the scan count is incremented by three. At intervals between four carriage scans, the printing medium 106 is not conveyed.

If it is determined that the calculated dot count is equal to or lower than the power monitoring threshold Dth, it is decided in step S409 to print in the selected printing mode, and a region which is originally printed by one carriage scan is printed according to the decided printing mode in step S410.

Figure 9:
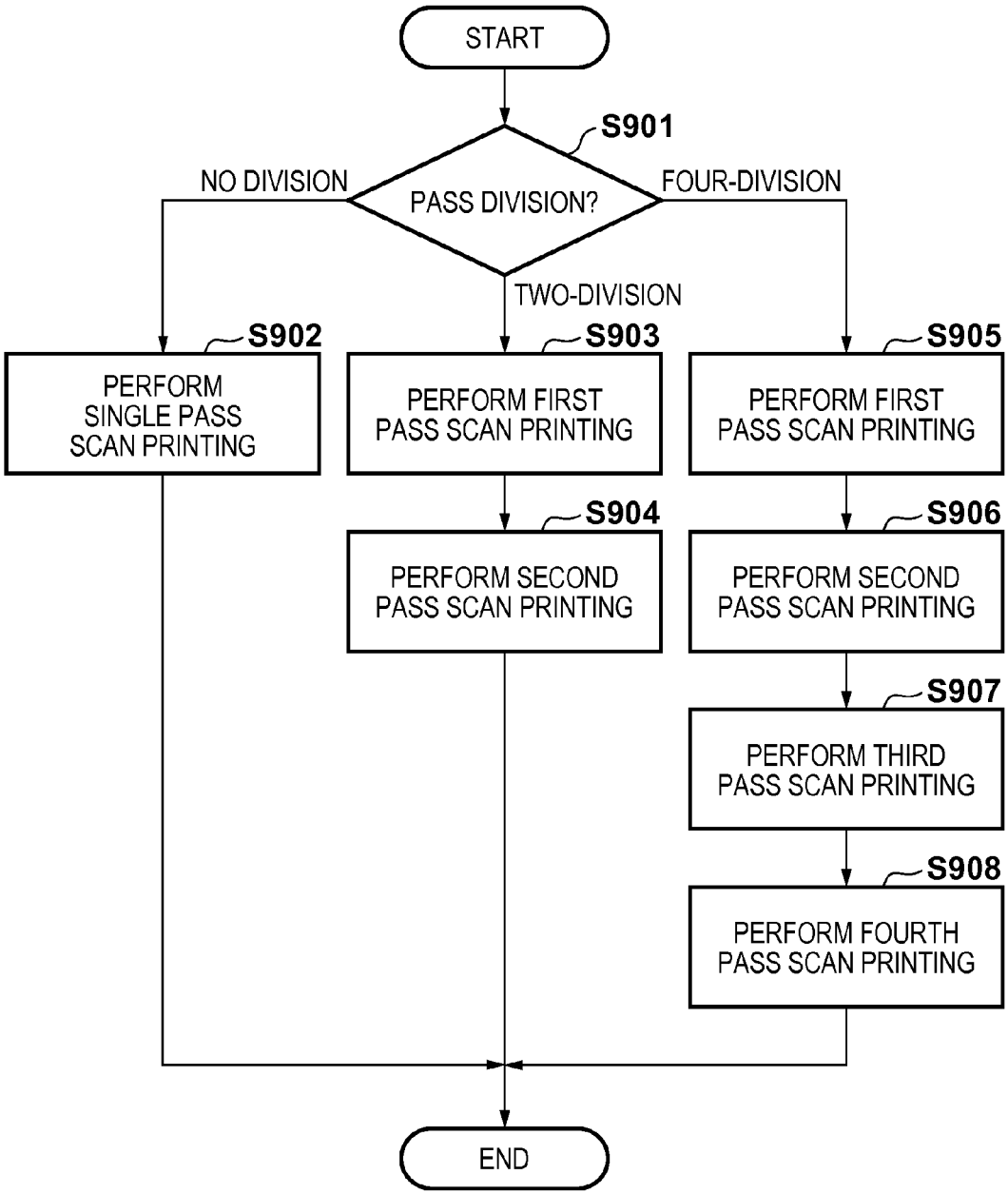
FIG. 9 is a flowchart showing detailed processing in step S410 of FIG. 4.

FIG. 9 shows a control sequence for explaining the processing in step S410. In step S901, the decided printing mode is examined. If no divisional printing is performed, the process advances to step S902. If printing is performed divisionally twice, the process advances to step S903. In this case, print data is divided into two portions. If printing is performed divisionally four times, the process advances to step S905. In this case, print data is divided into four portions. When the number of heaters used in one scan decreases in this way, the heater driving count per unit time in printing also decreases, thereby reducing the amount of power consumed by the printhead 102. Even though the 1-pass printing mode is designated, 1-pass printing or multi-pass printing is selected for the data unit of one scan corresponding to the printing mode, based on whether the temperature is high or low and/or whether the amount of print data for one scan is large or small. This control is executed similarly even in another printing mode.

An example of dividing heaters for use in order to reduce the consumption power of the printhead has been explained. However, even when the carriage speed is decreased, the heater driving count per unit time can also decrease, reducing the consumption power of the printhead 102. In this case, every time the printing mode is switched, a power monitoring threshold corresponding to the printing mode is referred to.

After the end of printing a predetermined region, the dot count of the next printing region is calculated. In step S411, it is determined whether or not printing of one entire page of the printing medium has ended. If it is determined that printing of the entire printing medium has ended, the process ends; if NO, a conveyance operation is performed by a conveyance amount corresponding to the printing mode in step S412. After that, the process returns to step S405 to wait for print data for the next scan.

As described above, conventional power monitoring control uses a fixed threshold, and the load of the printhead 102 is controlled to be equal to or lower than the threshold regardless of the ambient temperature. In printing in a high-speed mode in which the printing duty is high and the carriage scan count is low, power monitoring control increases the carriage scan count, prolonging the printing time. To the contrary, in control according to the above-described embodiment, when the ambient temperature of the printing apparatus is low, a power monitoring threshold Dth larger than a power monitoring threshold Dth used when the ambient temperature is high is referred to. This reduces chances of executing power monitoring control which results in slow printing operation. Even an image at high printing duty can be printed more quickly than by the conventional power monitoring control using a fixed threshold. This means an increase in the efficiency of the integrated power supply 201. According to the embodiment, the power monitoring threshold Dth is determined so that components installed in the integrated power supply 201 do not exceed their temperature ratings, and the components do not exceed their temperature ratings regardless of transmitted print data.

In the above-described embodiment, the temperature sensor 308 measures the ambient temperature of the printing apparatus, a power monitoring threshold stored in correspondence with the ambient temperature is referred to, and the dot count is compared with the power monitoring threshold. However, the present invention is not limited to this. The temperature sensor 308 may be arranged in the same space as the space in which the integrated power supply 201 is arranged. Alternatively, the temperature sensor 308 may be attached to a component whose temperature readily rises, and directly measure the temperature of the component. In this arrangement, the power monitoring threshold Dth can be set in accordance with a difference between the measured temperature and a temperature when the component comes close to the temperature rating. Control can be executed based on the set power monitoring threshold Dth. Actually arranging the temperature sensor near a component which readily reaches the temperature rating can reduce an error (or margin) generated from a temperature difference between a temperature measured by the temperature sensor and a component temperature. Higher-accuracy threshold setting can therefore be achieved.

[Second Embodiment]

The second embodiment will explain printing control which can be implemented by attaching a temperature sensor 308 to a location (near or directly to a component) where the temperature of a component whose temperature readily rises (high-temperature-dependent) can be measured. In the first embodiment, the load of a printhead 102 is predicted from a dot count (heater driving count) for one scan of the carriage, and power monitoring control is performed. In the second embodiment, a dot count for a plurality of carriage scans is calculated, and printing control is performed. Processing in this case is as follows.

First, the temperature sensor 308 measures the component temperature of an integrated power supply 201, and a power monitoring threshold Dth in a flash ROM 304 that corresponds to a printing mode and the component temperature is referred to and set. The dot count of a scan printing region A1 to be printed is calculated. Subsequently, print data of a printing region A2 to undergo scan printing next and that of a region A3 to undergo scan printing second next are received, and the dot counts of these regions are calculated.

Then, the average of the calculated dot counts of the three scan printing regions is obtained, and the obtained value is compared with the power monitoring threshold Dth. If the average value of the dot counts is smaller than the power monitoring threshold Dth, the first printing region A1 is printed in an original printing mode. In the embodiment, the average value of the dot counts of three successive carriage scans is calculated. For example, even when the dot count of the first printing region A1 is higher than the power monitoring threshold Dth, if the average is lower than the threshold, printing is possible in this mode.

After the end of printing in the first scan printing region A1, the average value of the dot counts of the next scan printing region A2, second next printing region A3, and third next scan printing region A4 is calculated. The value is compared with the power monitoring threshold Dth.

In this fashion, in the embodiment, the average value of the dot counts of a plurality of printing regions A1, A2, . . . , An is compared with the power monitoring threshold Dth, deciding a printing control method.

Figure 8:
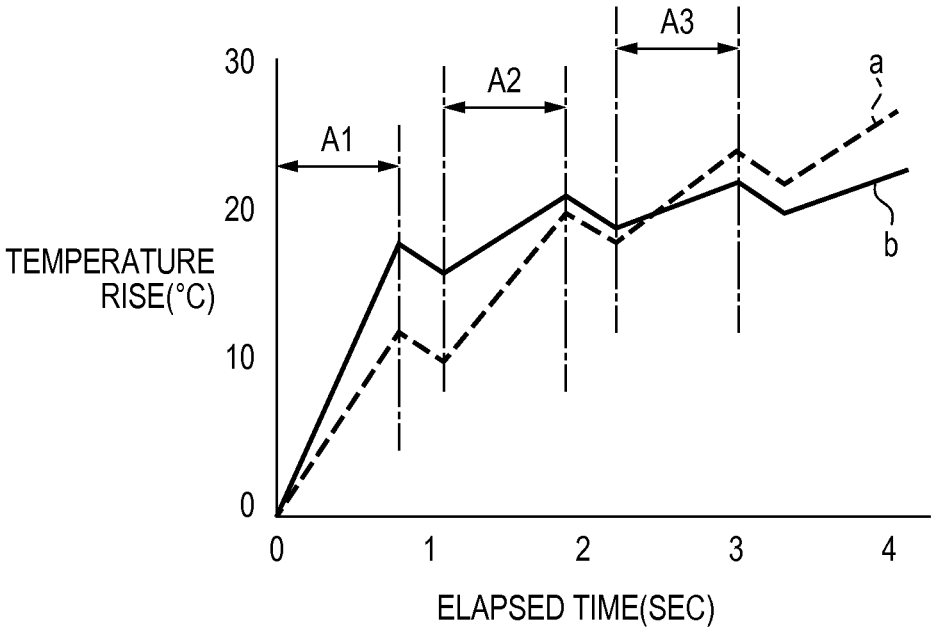
FIG. 8 is a graph showing a temperature rise of a component over time.

FIG. 8 is a graph showing, for each load of the printhead 102, a rise of the component temperature of the integrated power supply 201 upon a plurality of carriage scans.

Referring to FIG. 8, a dotted line a indicates a temperature rise when the loads of dot counts close to the power monitoring threshold Dth continue. A solid line b indicates a temperature rise when the load is higher than the power monitoring threshold Dth in the scan printing region A1, and much lower than the power monitoring threshold Dth in the scan printing regions A2 and A3.

Hence, even when the load exceeds the power monitoring threshold Dth in given scan printing, if the load is much lower in subsequent scan printing, a temperature rise can be suppressed to be equal to a temperature rise obtained when the load is kept to be equal to or lower than the power monitoring threshold Dth.

In the above-described embodiment, the temperature sensor 308 directly measures a component temperature, so a component temperature after the end of three carriage scans can be predicted at high accuracy from a component temperature immediately before printing. Depending on conditions, printing can be performed even if the value of a dot count exceeding the power monitoring threshold in given scan printing is counted. This can further increase the efficiency of the integrated power supply 201.

Note that the average of the dot counts of a plurality of carriage scans is compared with the power monitoring threshold Dth in the embodiment, but the present invention is not limited to this. For example, it is also possible to give a weighting coefficient to each carriage scan and compare the weighted sum with the power monitoring threshold Dth. In this case, the influence of heater driving in the second and third scans on the component temperature can be predicted at higher accuracy.

The scan count of a carriage 101 which performs dot counting is not limited to three, and may be any desired integer more than three.

Figure 10A:
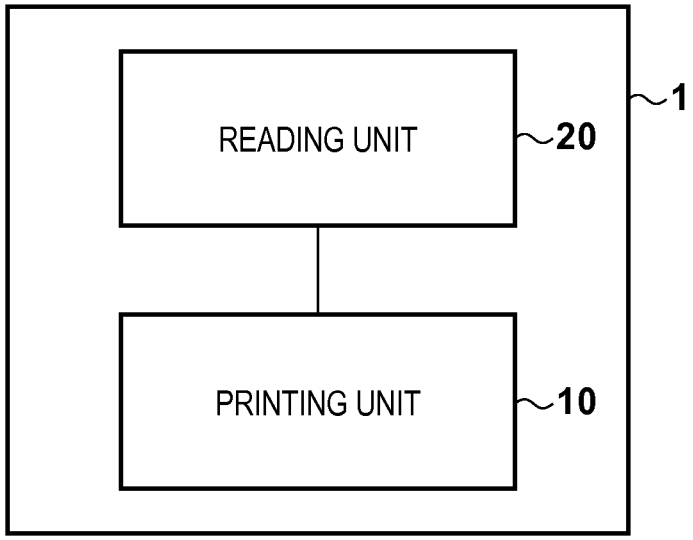
FIGS. 10A and 10B are block diagrams for explaining other forms of the printing apparatus.
Figure 10B:
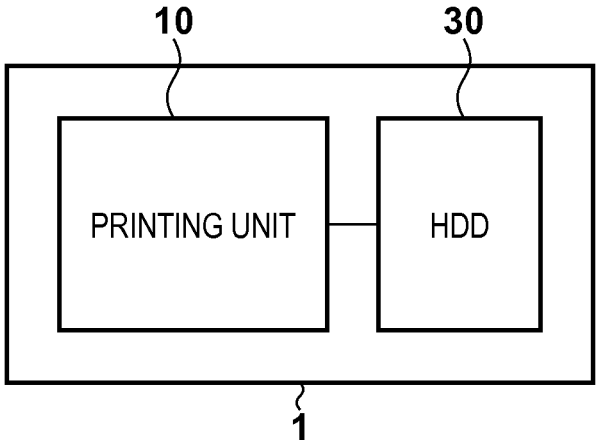

FIGS. 10A and 10B show other arrangements of a printing apparatus 1. FIG. 10A shows an arrangement in which the printing apparatus 1 includes a printing unit 10 and image reading unit (scanner) 20. In this arrangement, a print job may be received from the image reading unit (scanner). FIG. 10B shows an arrangement in which the printing apparatus 1 includes the printing unit 10 and an HDD (Hard Disk Drive) 30 which stores a print job. In this arrangement, a print job may be received from the HDD. In the arrangements of FIGS. 10A and 10B, for example, an interface 302 shown in FIG. 3 may be connected to the image reading unit (scanner) 20 or HDD 30. Alternatively, a dedicated interface may be arranged to connect the image reading unit (scanner) 20 or HDD 30. In the arrangements of FIGS. 10A and 10B, the printing mode is designated via an operation unit 301.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-168711, filed Aug. 1, 2011, which is hereby incorporated by reference herein in its entirety.

What is claimed is:

1. A printing apparatus comprising:

a printhead in which a plurality of printing elements are arrayed;

a scanning unit configured to scan the printhead with respect to a predetermined area on a printing medium in order to print an image on the printing medium;

a print data reception unit configured to receive print data used for printing by the printhead;

a temperature sensor configured to measure a temperature of a predetermined component of the printing apparatus or an ambient temperature of the printing apparatus;

a driving count information reception unit configured to receive information relating to a driving count of the plurality of printing elements to be driven for printing on the predetermined area, based on the print data received by the print data reception unit;

a driving control unit configured to, (i) in a case where the driving count of the plurality of printing elements indicated by the information received by the driving count information reception unit is equal to or less than a threshold value, drive the printhead to print the image based on the print data by one scan on the predetermined area, and (ii) in a case where the driving count of the plurality of printing elements indicated by the information received by the driving count information reception unit is larger than the threshold value, drive the printhead to print the image based on the print data by a plurality of scans on the predetermined area; and a determination unit configured to, (iii) in a case where the temperature sensor measures a first temperature, determine a first threshold value as the threshold value, among a plurality of threshold values, and (iv) in a case where the temperature sensor measures a second temperature which is higher than the first temperature, determine a second threshold value which is lower than the first threshold value as the threshold value, among the plurality of threshold values.

2. The printing apparatus according to claim 1, further comprising a power supply configured to supply power to each unit of the printing apparatus, wherein temperature ratings are defined for a plurality of electric components which form the power supply, and the temperature sensor is attached directly to or near a high-temperature-dependency component among the plurality of electric components.

3. The printing apparatus according to claim 1, wherein the plurality of threshold values are determined to prevent the temperature of the predetermined component of the printing apparatus from exceeding a predetermined temperature upon a printing operation.

4. The apparatus according to claim 1, wherein the printhead is an inkjet printhead which discharges ink.

5. A printing apparatus comprising:

a printhead in which a plurality of printing elements are arrayed;

a scanning unit configured to scan the printhead with respect to a first area on a printing medium in order to print an image on the printing medium;

a print data reception unit configured to receive print data used for printing by the printhead;

a temperature sensor configured to measure a temperature of a predetermined component of the printing apparatus or an ambient temperature of the printing apparatus;

a driving count information reception unit configured to receive information relating to an average driving count of the plurality of printing elements to be driven for printing on the first area and a second area to be printed next to the first area based on the print data received by the print data reception unit;

a driving control unit configured to, (i) in a case where the average driving count of the plurality of printing elements indicated by the information received by the driving count information reception unit is equal to or less than a threshold value, drive the printhead to print the image based on the print data by one scan on a predetermined area, and (ii) in a case where the average driving count of the plurality of printing elements indicated by the information received by the driving count information reception unit is larger than the threshold value, drive the printhead to print the image based on the print data by a plurality of scans on the predetermined area; and a determination unit configured to, (iii) in a case where the temperature sensor measures a first temperature, determine a first threshold value as the threshold value, among a plurality of threshold values, and (iv) in a case where the temperature sensor measures a second temperature which is higher than the first temperature, determine a second threshold value which is lower than the first threshold value as the threshold value, among the plurality of threshold values.

6. The printing apparatus according to claim 1, wherein (ii) in a case where the driving count of the plurality of printing elements indicated by the information received by the driving count information reception unit is larger than the threshold value, the driving control unit divides the plurality of printing elements into a plurality of printing element groups, each including a predetermined number of printing elements continuously arrayed in the printhead, and drives one of the plurality of printing element groups in each of the plurality of scans.

7. The printing apparatus according to claim 1, wherein a predetermined component of the printing apparatus is a high-temperature-dependent electric component which forms a power supply configured to supply power to each unit of the printing apparatus.

8. The printing apparatus according to claim 1, wherein each of the plurality of printing elements is an electrothermal transducer.

9. A printing method in a printing apparatus for printing an image by using a printhead in which a plurality of printing elements are arrayed, comprising;

scanning the printhead with respect to a predetermined area on a printing medium in order to print the image on the printing medium;

receiving print data used for printing by the printhead;

measuring, by a temperature sensor, a temperature of a predetermined component of the printing apparatus or an ambient temperature of the printing apparatus;

receiving information relating to a driving count of the plurality of printing elements to be driven for printing on the predetermined area, based on the received print data;

in a case where the driving count of the plurality of printing elements indicated by the received information is equal to or less than a threshold value, driving the printhead to print the image based on the print data by one scan on the predetermined area;

in a case where the driving count of the plurality of printing elements indicated by the received information is larger than the threshold value, driving the printhead to print the image based on the print data by a plurality of scans on the predetermined area;

in a case where the temperature sensor measures a first temperature, determining a first threshold value as the threshold value, among a plurality of threshold values; and in a case where the temperature sensor measures a second temperature which is higher than the first temperature, determining a second threshold value which is lower than the first threshold value as the threshold value, among the plurality of threshold values.

* * * * *